United States Patent [19]

Shallenberger

[11] 4,453,483

[45] Jun. 12, 1984

[54] SAIL ASSEMBLY FOR VESSELS

[76] Inventor: Frank K. Shallenberger, 191 Forest La., Menlo Park, Calif. 94025

[21] Appl. No.: 389,298

[22] Filed: Jun. 17, 1982

Related U.S. Application Data

[63] Continuation of Ser. No. 142,248, Apr. 21, 1980, abandoned.

[51] Int. Cl.[3] ..... B63H 9/04

[52] U.S. Cl. ..... 114/102; 114/39

[58] Field of Search ..... 114/102, 103, 104, 39; 440/8

[56] References Cited

U.S. PATENT DOCUMENTS

| | | | |
|---|---|---|---|
| 1,348,912 | 8/1920 | Ward | 114/39 |
| 1,504,057 | 8/1924 | Koelkebeck | 114/103 |
| 2,319,999 | 5/1943 | Jennings | 114/102 |
| 2,387,907 | 10/1945 | Hook | 114/39 |
| 3,371,636 | 3/1968 | Sharp | 114/103 |
| 4,116,151 | 9/1978 | Guthrie | 114/102 |

FOREIGN PATENT DOCUMENTS

| | | | |
|---|---|---|---|
| 1423958 | 11/1965 | France | 114/39 |
| 1134312 | 11/1968 | United Kingdom | 114/39 |

*Primary Examiner*—Galen L. Barefoot
*Assistant Examiner*—Jesûs D. Sotelo
*Attorney, Agent, or Firm*—Flehr, Hohbach, Test, Albritton & Herbert

[57] ABSTRACT

A sail assembly for vessels which includes a plurality of elongated vanes or sails having a high aspect ratio to increase efficiency.

15 Claims, 17 Drawing Figures

SAIL ASSEMBLY FOR VESSELS

This application is a continuation of co-pending application, Ser. No. 142,248, filed Apr. 21, 1980 now abandoned.

This invention relates generally to a sail assembly for vessels and more particularly to such an assembly employing a plurality of parallel elongated narrow vanes.

C. Hook of Burfield, Bosham, Sussex, England, has described a sailing ship or vessel which includes a sail assembly including a plurality of Princeton sail wings fixedly mounted in parallel relationship next to each other. The assembly is rotated about an axis which is perpendicular to the longitudinal axis of the vessel. By rotating the assembly, the angle of the sails or foils with respect to the wind can be controlled. Each of the sail wings is relatively wide and is formed of cloth or canvas stretched over a tube or rod and secured or tensioned at its trailing edge. The sail wings are furled by winding them around the vertical mast associated with each of the sails.

It is known that the efficiency of an air foil is largely dependent upon the aspect ratio which is defined as $AR=s^2/A$ where s is the length of the foil and A is its area. Referring particularly to FIG. 17 of the drawing, it is seen that the greater the aspect ratio, the greater the lift curve slope and the consequent coefficient of lift or force which is generated by the wind flowing past the sail. Further, the higher $C_L$ of the high AR is achieved at a lower coefficient of drag ($C_D$) the force that in close reaching is the overturning force. The same principle, that is the higher lift and low drag with a high aspect ratio, is demonstrated in nature by the long narrow wings of soaring birds and in man-made machines such as high performance gliders. The same principle applies to sailboats wherein in close reaching and reaching (35°–100° to the wind) the sail acts in the same manner as a wing. The sail uses aerodynamic lift to provide a propulsion. A sail with a high aspect ratio is preferred. In broad reaching (100°–170°) or in running (130°–180°) where aerodynamic drag provides the driving force, a sail with a low aspect ratio is more efficient. However, even in broad reaching with a fast boat, catamaran or ice boat, the speed of the boat brings the "apparent" wind towards the reaching position where the high aspect ratio sail is more efficient. For example, if the boat is sailing in a true wind of 10 knots and a boat speed of 6 knots at an angle of 130° to the wind (broad reach), the apparent wind will be about 90° to the course of the boat (reaching) where the high aspect ratio sail is at its highest efficiency.

The aspect ratio of sails used on old clipper ships was between $\frac{1}{3}$ and $\frac{2}{3}$. The aspect ratio of a typical gaff sail is about 1. The aspect ratio of a Marconi rig is about 4. Even in a high speed racing boat, the aspect ratio never reaches more than about 6 because of the problems of stability caused by the necessity of having extremely high masts. A sail with an aspect ratio of 10 has a lift curve slope of about 0.085. Thus, if it were possible to build a sail with an aspect ratio of 10, it would have substantially higher coefficient of lift or force than the typical Marconi rig.

Moreover, the mast to which the Marconi sail is attached seriously interferes with the flow over the sail, decreasing the coefficient of lift of the wind sail by as much as 20% or more depending upon the diameter and shape of the mast and how it is attached to the sail.

Conventional masts are rigidly attached to the hull so that when the hull heels, the mast and sail also heel presenting the sail at an angle which is a less efficient surface. Finally, the lift generated by the sail is largely affected by the camber of the sail. Most conventional sails are single cambered and, thus, have only about 50% of the lift of a double cambered sail such as that used in the present invention.

It is an object of the present invention to provide a sail assembly including a plurality of vanes having a high aspect ratio supported from a frame.

It is another object of the present invention to provide a sail assembly including a plurality of vanes having high aspect ratio, rigid and double cambered, whereas to provide greater drive forces and longer life than soft canvas sails.

In accordance with still another object of the present invention, the high aspect vanes are mounted in a frame which is supported by spaced short masts in such a manner that the frame can be rotated about an axis parallel to the longitudinal axis of the ship to present the leading edge of the vanes to oncoming wind from either direction and to be horizontally disposed for furling.

In accordance with another object of the invenstion, there is provided a plurality of such frames, one above the other, whereby air foils can be adjusted to accommodate gradients in the wind at different heights above the water.

In accordance with a further object of the invention, the frames are mounted so that they not only can be rotated about an axis parallel to the longitudinal axis of the ship, but also on a vertical axis perpendicular thereto whereby the vane assembly can be turned with the leading edge of the vanes towards the wind.

It is a further object of the present invention to provide a sail assembly including a pluarlity of spaced parallel rigid vanes.

It is another object of the invention to provide a vane assembly which has a high aspect ratio and yet is rectangular in shape whereby the available space above the hull of the vessel can be filled with vanes or sail.

The foregoing and other objects of the invention are achieved by a vane and mast assembly for sailing vessels comprising at least one pair of spaced masts adapted to be mounted on the vessel, a plurality of high aspect ratio vanes, and means for mounting said vanes parallel to one another between said masts. The invention is further characterized in that the vanes can be positioned to present the leading edge of the vanes to the wind regardless of the direction of the wind and can be disposed horizontally for reefing. Preferably, the vanes are rigid vanes having the shape of an airfoil to thereby increase their efficiency.

The foregoing and other objects and features of the invention can be more clearly understood from the following description taken together with the accompanying drawings in which.

Figure 12:
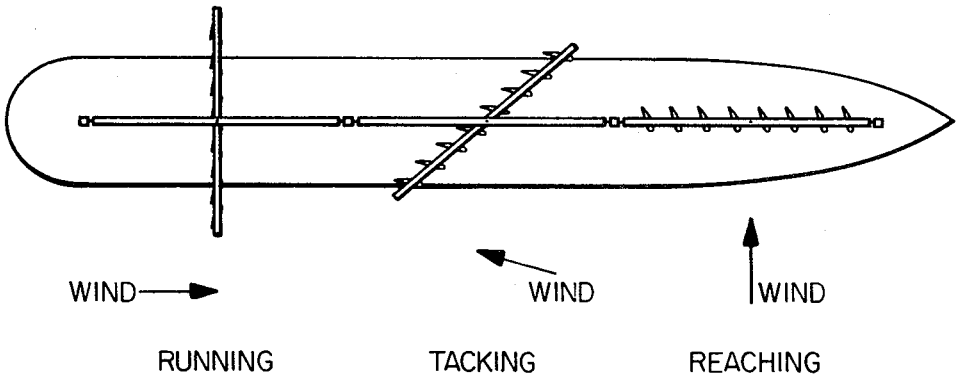

FIG. 12 schematically shows various positions for the sail assembly as, for example, for running downward of wind, for tacking and for reaching.

Figure 13:
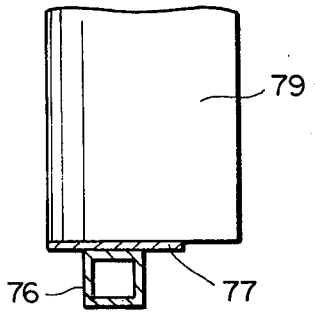
Figure 14:
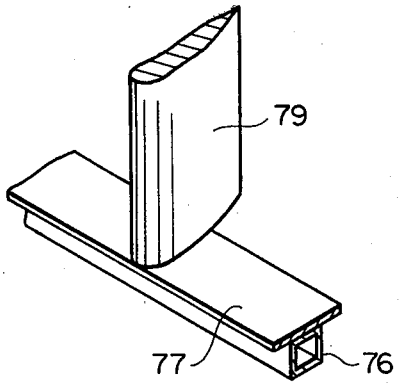

FIGS. 13 and 14 show a means for securely mounting the ends of the vanes in a frame.

Figure 15:
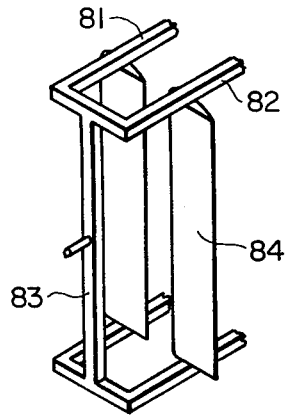

FIG. 15 shows a frame including two rows of vanes to form a double sail.

Figure 16:
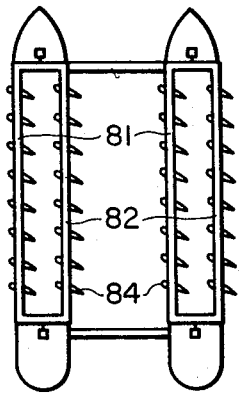

FIG. 16 shows double sails on a catamaran or the like.

Figure 17:
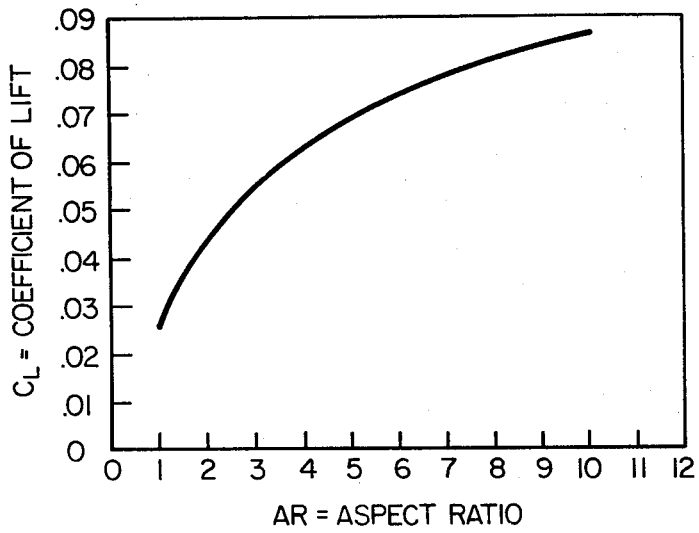

FIG. 17 is a plot of the coefficient of lift as a function of the aspect ratio.

FIGS. 1–6 illustrate a sailing vessel 11 including spaced masts 12 and 13 which may be reinforced by stays 14. A frame 16 is supported between the masts 12 and 13 by means of pivots 17 and 18 whereby the frame assembly can be rotated about an axis parallel to the longitudinal axis of the vessel 11. A plurality of vanes (sails) 21 are mounted between the upper and lower frame members 22 and 23. The vanes are mounted in spaced relationship adjacent to one another. In one embodiment of the invention the vane members are pivotally mounted with upper and lower pins 26 whereby they can rotate within the frame. Preferably, the pins are forward of center, toward the leading edge, so that if the vanes are released, the force of the wind will cause the vanes to turn and face into the wind whereby to unload the sail. The angle of the vanes can be controlled by means of a drive rod 27, FIG. 6, which is pivotally attached to the trailing edge of the vanes by a pin 28 whereby as the rod is moved longitudinally, as shown by the arrow 29, the vanes are rotated to control their angle of attack with respect to the wind.

Figure 1:
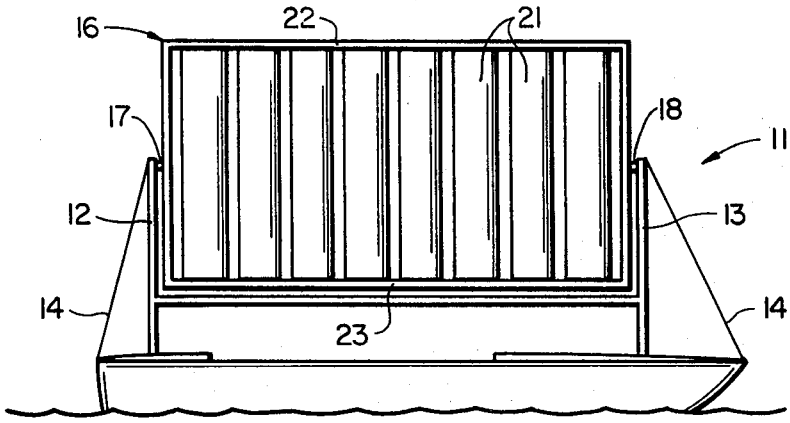
FIG. 1 is a side elevational view of a sailing vessel including a sail assembly in accordance with the invention.
Figure 2:
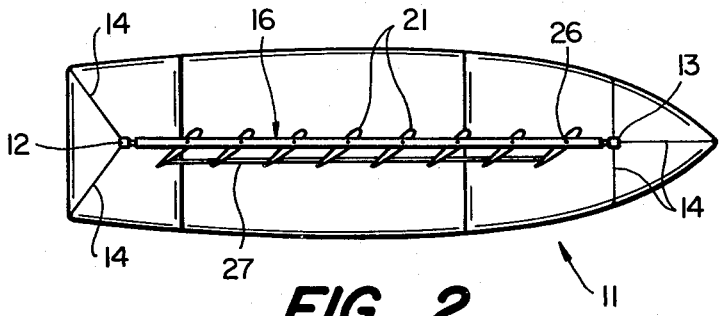
FIG. 2 is a plan view of the vessel shown in FIG. 1.
Figure 3:
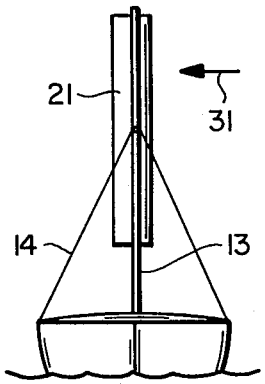
FIG. 3 is a front elevational view of the vessel of FIG. 1.
Figure 4:
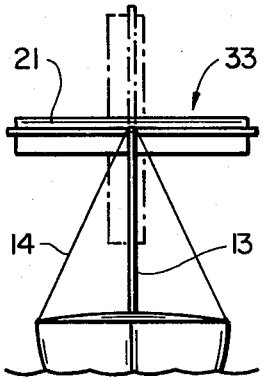
FIG. 4 shows the vessel of FIG. 1 with the vanes reefed.
Figure 5:
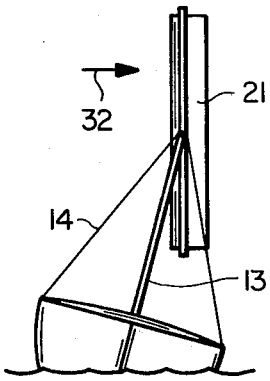
FIG. 5 shows the vessel of FIG. 1 with the wind approaching from the left with the ship tilted and the sail presenting its full area to the incident wind.
Figure 6:
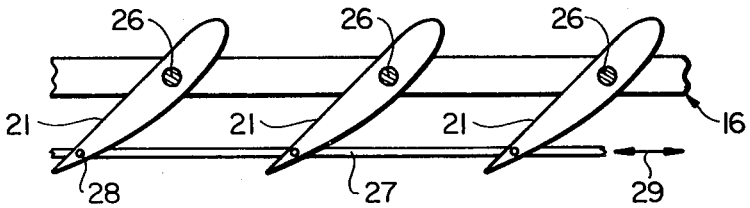
FIG. 6 shows a mechanical arrangement for rotating the vanes within the frame so as to present the leading edge at proper angle to the wind.

Referring to FIG. 3, the sail assembly is arranged whereby the vanes are directed into a wind coming from the direction shown by the arrow 31 with the angle adjustable to provide the most efficient aerodynamic lift. In FIG. 5, the vanes are shown directed into the wind shown by arrow 32 with the force of the wind having tilted the vessel. However, the frame is pivoted about the pivots 17 and 18 whereby it presents its total frontal area to the oncoming wind 31. In high winds or when mooring the ship, the sail assembly is rotated to a horizontal position such as shown at 33, FIG. 4, whereby very little frontal area is presented to the wind, the sail assembly is reefed, and the vessel is stable. From FIGS. 3 and 5 it is seen that the frame has been rotated to present the front edge of the vanes to the wind 31 coming from the right-hand side, FIG. 3, while it has been rotated to present the front edge of the vanes to the wind coming from the left-hand side, FIG. 5.

Figure 7:
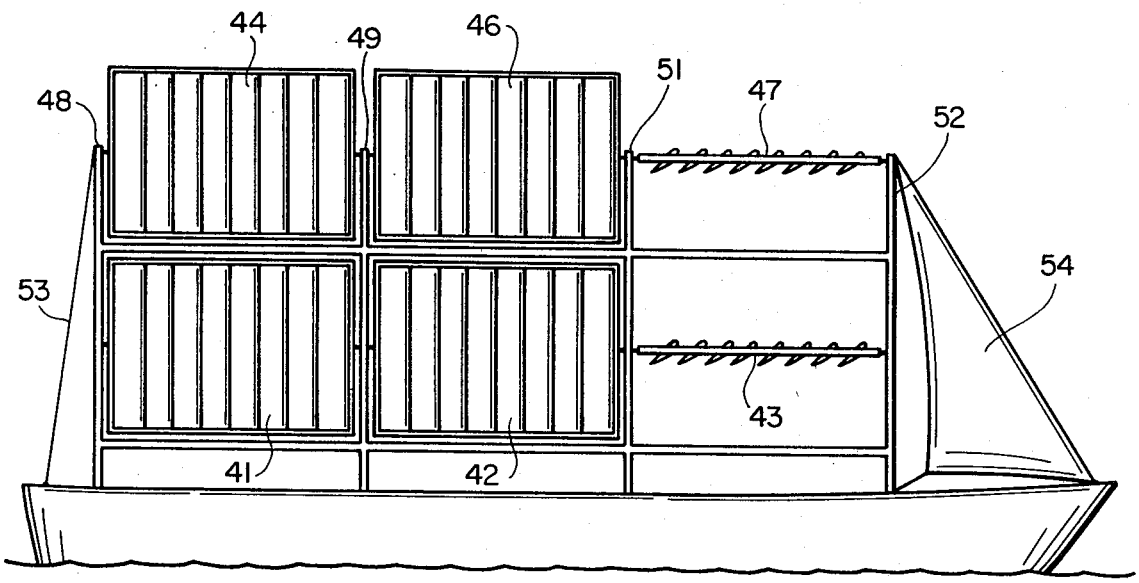
FIG. 7 shows a sailing vessel including a vane assembly of the type shown in FIG. 1 with a plurality of masts and sail assemblies including vanes at two levels to provide more propulsion.
Figure 8:
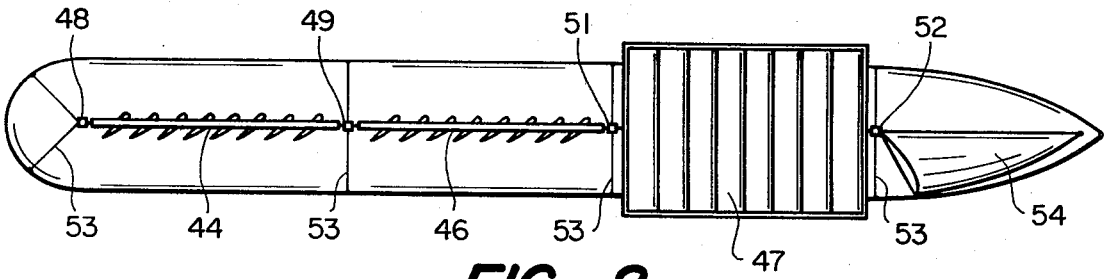
FIG. 8 is a plan view of the ship shown in FIG. 7.
Figure 9:
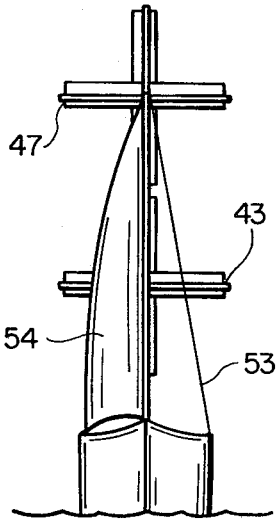
FIG. 9 is a front view of the ship shown in FIGS. 7 and 8.

In larger sailing vessels more sailing area can be provided by employing a plurality of sail assemblies such as shown in FIGS. 7–9. The sail shown includes a lower row of sail assemblies 41, 42 and 43 and an upper row of sail assemblies 44, 46 and 47. The sail assemblies are rotatably mounted between masts 48, 49, 51 and 52 which may be reinforced by stay lines 53. Each of the assemblies may be of the types previously described. It is seen that the sail assemblies 41, 42, 43, 44, 46 and 47 may be independently operated whereby to be reefed or to present the proper angle to different wind velocities above the water surface. This can aid in taking advantage of the gradients in the wind from the surface of the ocean to the top of the sails. A conventional jib sail 54 may be added to provide reaching or downwind propulsion, or wing sails may be mounted on the side stays.

Figure 10:
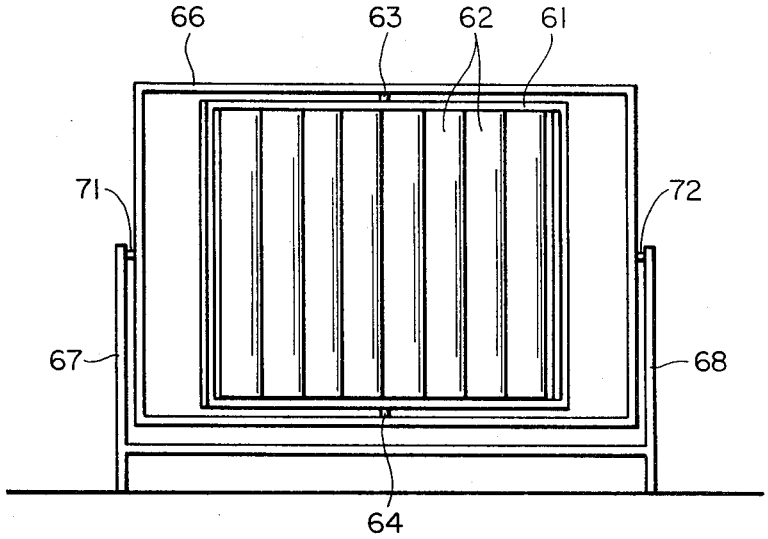
FIG. 10 shows a sail assembly which can be rotated about an axis perpendicular to the axis of the ship as well about an axis parallel to that of the ship.
Figure 11:
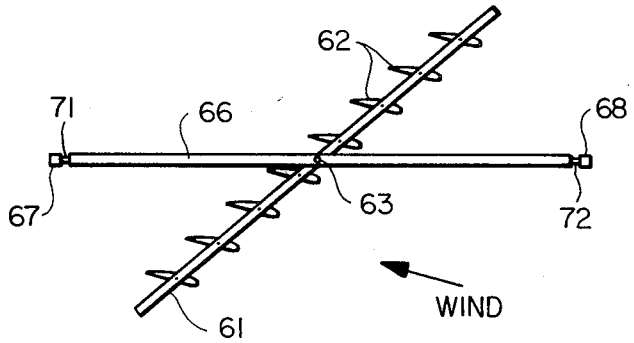
FIG. 11 shows the sail assembly of FIG. 10 rotated about the perpendicular axis to face the wind.

In another embodiment the vanes forming the sail assembly can be rigidly mounted in the frame and the frame mounted within a second frame so that it can rotate about an axis perpendicular to the longitudinal axis of the ship. Referring particularly to FIG. 10, there is shown an inner frame 61 adapted to rigidly mount a plurality of parallel vanes 62. The frame 61 may rotate about spaced pivots 63 and 64 which mount the frame to outer frame 66. The outer frame is rotatably mounted to masts 67 and 68 by pins 71 and 72. The sail assembly can be rotated to present the front edge of the vanes to the oncoming winds such as shown in FIGS. 11 and 12 and provides an advantage for running downwind as shown in FIG. 12 in that the sail assembly can be rotated to present its total surface to the oncoming wind. Various other positions such as tacking and reaching are illustrated in FIG. 12 by one of the three sets of sails disposed along the axis of a multiple sail ship.

Referring to FIGS. 13 and 14, there is shown one method of rigidly mounting the vanes 79 to a frame member 76. The vanes are secured to plate 77 which in turn is secured to the frame. A similar mounting is formed at the top of the frame. This seals the ends of the vanes and increases the effective aspect ratio.

Since the wind will travel over the sails aerodynamically and smoothly, additional lift or force can be derived by providing two rows of vanes, one following the other, so that the wind impinges sequentially on each set. This increases the sail area without increasing the height. A frame for mounting two rows of vanes is illustrated in FIG. 15 and includes a double frame having parallel frame members 81 and 82 with a vertical frame member 83 and the vanes 84 suitably attached thereto either rotatably or rigidly. The assembly of FIG. 15 is shown mounted on a catamaran in FIG. 16 where there are presented four sail assemblies with four rows of vanes, one downstream of the other.

Thus, there has been provided an improved sail assembly for use on sailing vessels. The assembly employs vanes or sails having a high aspect ratio whereby to increase the coefficient of lift in the same manner as one finds in high efficiency birds, sail planes or gliders.

What is claimed is:

1. A sail and mast assembly for vessels comprising at least one mast adapted to be mounted on the vessel, a plurality of elongated rigid vanes or sails having an aspect ratio greater than five, each of said vanes or sails shaped as an airfoil, a frame, means for rotatably mounting said vanes or sails to said frame at their ends and parallel to and spaced from one another in said frame to form a sail assembly, and means for mounting said frame to said at least one mast for rotation about a horizontal axis which extends through the vertical center of each of said vanes or sails so that the frame can be rotated for reefing or for accepting the wind from either side of the boat.

2. A sail and mast assembly for vessels comprising at least one pair of spaced masts adapted to be mounted on a vessel, a plurality of elongated narrow sails or vanes, a frame, means for rotatably mounting each of said sails or vanes to said frame in spaced relationship and parallel to one another so that they may be rotated about an axis parallel to the longitudinal axis of the sails or vanes, and means for pivotally mounting said frame between said masts whereby the frame and sails can be rotated about an axis which extends through the vertical center of each of said sails or vanes and is parallel to the longitudinal axis of the vessel so that the frame can be rotated for reefing or accepting the wind from either side of the vessel.

3. A sail and mast assembly as in claim 2 wherein said vanes have a high aspect ratio.

4. A sail and mast assembly as in claim 2 wherein each of said vanes is rigid.

5. A sail and mast assembly as in claim 4 wherein each of said rigid vanes is in the shape of an airfoil.

6. A sail and mast assembly for vessels as in claim 2 wherein said mounting means for the vanes is forward of the center of pressure whereby when said vanes are released they are automatically directed into the wind.

7. A sail and mast assembly as in claim 2 in which said frame is adapted to receive at least two rows of sails with the rows spaced from one another.

8. A sail and mast assembly as in claim 2 in which said means for pivotally mounting said frame between said masts includes means for mounting said frame whereby the sails and frame can be rotated about an axis perpendicular to the longitudinal axis of the vessel.

9. A sail and mast assembly for vessels comprising at least one pair of spaced masts adapted to be mounted on a vessel, a plurality of elongated vanes, at least two frames, means for mounting a first and second plurality of said vanes to first and second ones of said frames in spaced parallel relationship to one another, and means for pivotally mounting said frames between said masts one above the other whereby said frame and associated vanes can be independently rotated about an axis parallel to the longitudinal axis of the ship.

10. A sail and mast assembly as in claim 9 wherein said vanes have a high aspect ratio.

11. A sail and mast assembly as in claim 10 wherein each of said vanes is rigid.

12. A sail and mast assembly as in claim 11 wherein said rigid vane is in the shape of an airfoil.

13. A sail and mast assembly as in claim 9 wherein said means for mounting said vanes to said frame rotatably mount said vanes to permit each of the vanes to be rotated about an axis parallel to its longitudinal axis.

14. A sail and mast assembly for vessels as in claim 13 wherein said mounting means is forward of the center of pressure whereby when said sails are released, they are automatically directed into the wind.

15. A sail and mast assembly for vessels comprising at least one mast adapted to be mounted on the vessel, a plurality of elongated vanes or sails, mounting means for rotatably mounting said vanes or sails parallel to one another so they may be rotated about an axis parallel to the longitudinal axis of the vanes or sails and means for mounting said mast so that the vane or sail mounting means and mounted vanes or sails can be rotated about a horizontal axis which extends through the vertical center of each of said vanes or sails for reefing or accepting the wind from either side of the vessel.

* * * * *